United States Patent [19]

Helgesson et al.

[11] 4,150,467

[45] Apr. 24, 1979

[54] METHOD AND MANDREL FOR BLIND RIVETING

[76] Inventors: Carl O. Helgesson, Ankdammsgatan 21, Solna; Jan F. Wallenius, Näsby Allé 59, Taby, both of Sweden

[21] Appl. No.: 905,119

[22] Filed: May 11, 1978

[30] Foreign Application Priority Data

Nov. 10, 1976 [SE] Sweden ..... 7612485

[51] Int. Cl.[2] ..... B21J 15/34

[52] U.S. Cl. ..... 29/26 B; 29/34 B; 29/243.53; 72/391

[58] Field of Search ..... 72/391; 29/243.53, 243.54, 29/243.52, 26 A, 26 B, 33 K, 34 B

[56] References Cited

U.S. PATENT DOCUMENTS

| | | | |
|---|---|---|---|
| 3,105,605 | 10/1963 | Bell | 29/243.54 |
| 3,412,594 | 11/1968 | Lund | 72/391 |
| 3,616,673 | 11/1971 | Miklos | 72/391 |
| 3,659,449 | 5/1972 | Abernathy | 72/391 |
| 4,003,288 | 1/1977 | Jeal | 72/391 |
| 4,085,377 | 4/1978 | Moeller | 72/391 |

*Primary Examiner*—C. W. Lanham
*Assistant Examiner*—Gene P. Crosby
*Attorney, Agent, or Firm*—Finnegan, Henderson, Farabow & Garrett

[57] ABSTRACT

A method in blind riveting comprises the step of using a mandrel which is withdrawn completely through the tubular rivet for setting the rivet, as a drill for cutting the hole through which the shank of the rivet is to be inserted. The hole is cut by means of an eccentric drill bit on the mandrel, which can pass through the passage of the set rivet.

7 Claims, 10 Drawing Figures

METHOD AND MANDREL FOR BLIND RIVETING

This invention relates to a method in blind riveting wherein the shank of a hollow or tubular rivet after having been inserted through a hole together with a mandrel extending through the rivet, is widened by withdrawing the mandrel through the shank for setting the rivet.

The blind-riveting method of the invention is of the type wherein no part of the mandrel is left in the passage through the hollow or tubular rivet when the rivet has been set.

When two elements, usually metal sheets, are to be interconnected by blind riveting it is necessary to drill initially a hole through the elements, having a diameter at least as large as the outside diameter of the shank of the rivet. The hole is drilled by means of a common drilling machine tool and then the shank of the hollow or tubular rivet is inserted through the hole from the outside surface of the two elements so that the head of the rivet abuts said surface. The rivet is inserted with a mandrel positioned in the rivet said mandrel having an enlarged portion disposed at the inner end of the rivet shank outwardly of the passage through the rivet. The mandrel projects from the head of the rivet. Then, the rivet is set by withdrawing the mandrel through the passage of the rivet by means of another machine tool having an abutment which is positioned against the head of the rivet, and a chuck or similar means for gripping the mandrel at the projecting part thereof. Means are provided in the machine tool for exerting a pulling force on the mandrel while the abutment is being pressed against the head of the rivet. In this manner the enlarged portion of the mandrel is drawn through the passage of the rivet which is widened and thus is caused to grip the surrounding material of the elements to be interconnected.

In one type of blind riveting the mandrel is completely withdrawn from the hollow or tubular rivet and can then be used for another riveting operation, and in another type of blind riveting part of the mandrel is left in the passage through the rivet.

It has been proposed in connection with the type of blind riveting wherein part of the mandrel is left in the shank of the rivet to provide the mandrel with a drill bit so that the hole for the shank can be drilled in the elements to be interconnected by means of the mandrel and the rivet then can be set by means of the same mandrel. In that case one and the same machine tool can be used for both operations and the time-consuming change of machine tool is avoided.

However, in the process of blind riveting wherein the mandrel is completely withdrawn from the rivet it has not so far been possible to solve the problem involved in passing a drill which is used for drilling a hole with a diameter at least as large as the outside diameter of the shank of the rivet, through the substantially narrower passage of the hollow or tubular rivet.

It is a primary object of this invention to provide a new and improved method in blind riveting in which the mandrel is used for drilling the hole for the shank of the rivet and is then completely withdrawn from the rivet when the rivet has been set by means of the mandrel.

It is a further object of this invention to provide a new and improved method in blind riveting in which the mandrel can be used for drilling the hole for the shank of the rivet and for setting the rivet when inserted through the hole, without the necessity of changing the mandrel from one machine tool to another one.

A still further object of the invention is to speed up and make more effective the method of blind riveting wherein the mandrel is withdrawn completely from the rivet.

Yet another object of this invention is to provide a new and improved mandrel for working the blind-riveting method of the invention.

Additional objects and advantages of the invention in part will be set forth in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, there is provided a method in blind riveting wherein the shank of a hollow or tubular rivet after having been inserted through a hole, together with a mandrel extending through the rivet, is widened by withdrawing the mandrel through the rivet for setting the rivet, and wherein the hole is cut by using the mandrel as a drill, the tubular rivet being slipped on to the mandrel, characterized in that the hole is cut by means of a drill bit located on the mandrel at one end thereof eccentrically in relation to the axis of the mandrel, that the rivet is widened by means of a cylindrical portion of the mandrel located between the other end thereof and said bit, to an inside diameter which is at least as large as the largest cross dimension of the eccentric bit, and that the mandrel is then removed from the set rivet by passing the eccentric bit through the tubular rivet.

There is also provided according to the invention a mandrel for blind riveting comprising a stem on to which a hollow or tubular rivet can be slipped from one end thereof, characterized by a bit located at the other end of the mandrel eccentrically in relation to the axis of the mandrel, the largest cross dimension of which is smaller than or equals the diameter of a cylindrical portion located between the stem and the eccentric bit of the mandrel for widening the hollow or tubular rivet, the eccentric bit and the cylindrical portion being spaced axially.

It is preferred that the mandrel at said other end has a centre pin forming a drill bit the diameter of which is smaller than the diameter of the circle described by the eccentric bit when the mandrel is being rotated.

It is also preferred that the mandrel between the eccentric bit and the cylindrical portion be eccentric towards the same side as the eccentric bit and have a cross dimension which is smaller than the largest cross dimension of the eccentric bit and the diameter of the cylindrical portion.

Finally, it is also preferred that the eccentric bit and the cylindrical portion be spaced axially a distance which is at least as large as the total length of the hollow or tubular rivet to be set.

The accompanying drawings which are incorporated in and constitute a part of this specification, illustrate embodiments of the invention and, together with the description, serve to explain the principles of the invention.

Figure 1:
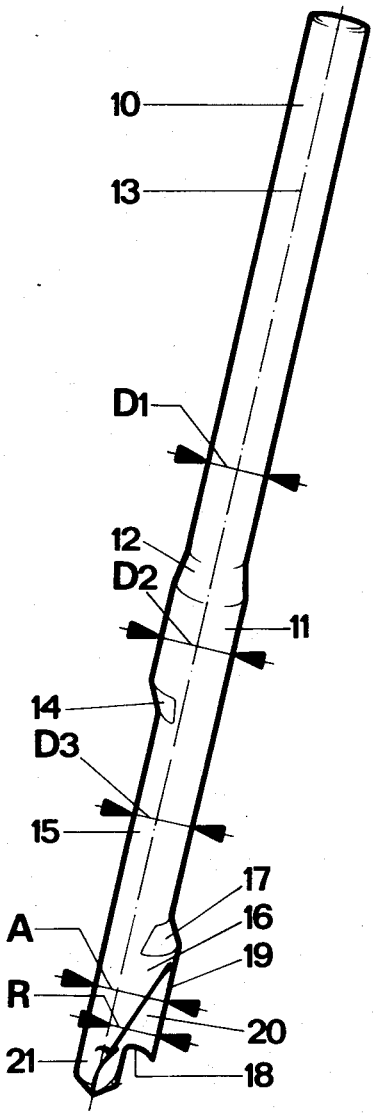
FIG. 1 is a perspective view of a mandrel formed as a drill according to the teachings of the invention to be used in working the method in blind riveting of the invention.
Figure 3:
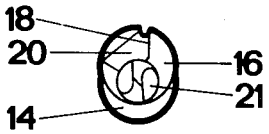
FIG. 3 is an end view of the mandrel.
Figure 2:
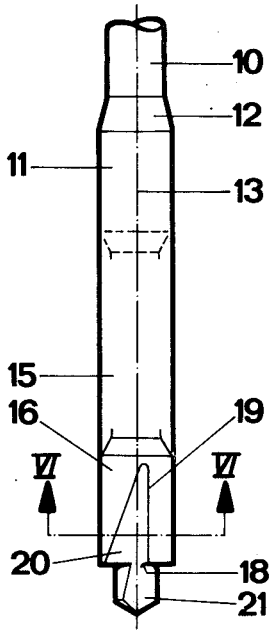
FIG. 2 is a fragmentary side view of the lower part of the mandrel in FIG. 1.
Figure 4:
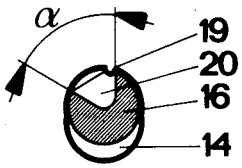
FIG. 4 is a cross sectional view taken along line IV–IV in FIG. 2.

Reference will now be made in detail to the present preferred embodiments of the invention, examples of which are illustrated in the accompanying drawings.

Referring now to FIGS. 1 to 4 there is shown a mandrel according to the teachings of the invention to be used for working the blind-riveting method of the invention.

The mandrel is made of steel of such quality as is used in conventional drills and comprises a cylindrical stem 10 at which the mandrel shall be attached to a machine tool. The cylindrical stem joins a wider cylindrical portion 11 at a conical transition portion 12, and the stem and the portions 11 and 12 are all coaxial with the axis of the mandrel indicated by a dash and dot line 13 in FIGS. 1 and 2.

At a shoulder 14 forming part of a conical surface the cylindrical portion 11 connects to a cylindrical portion 15 arranged eccentrically to the axis 13. The diameter of the portion 15 is less than the diameter of the cylindrical portion 11, portions 11 and 15 joining each other linearily at the side of the mandrel which is opposite to the shoulder 14. At said side the portion 15 joins a laterally projecting portion 16 at a conical surface 17, and said projecting portion forms a radial drill bit 18 and an axial drill bit 19 and also an associated chip deflector 20 the angle $\alpha$ of which preferably is 60°. Finally, the mandrel terminates in a centre pin 21 formed as a twist drill which is coaxial with the axis 13 of the mandrel.

The stem 10 has a diameter D1 which is equal to and preferably smaller than the smallest inside diameter of a hollow or tubular rivet used for blind riveting so that the rivet can be easily slipped on to the stem from the upper end thereof. The diameter D2 of the portion 11 corresponds to the inside diameter to which the rivet is to be widened when it is set in a hole in the usual manner by drawing portion 11 through the bore of the rivet. The largest cross dimension of the laterally projecting portion 16 is designated A, and according to the teachings of the invention this dimension is equal to and preferably smaller than the diameter D2. It will be understood that the bits 18 and 19 when the mandrel is rotating about the axis 13 will cut a bore the diameter of which is 2R where R is the radius of the axial bit 19 as measured from the axis 13. The diameter 2R of the hole cut by bits 18 and 19 should be large enough to allow the shank of the rivet to be set to be easily inserted through said hole, and the diameter 2R is preferably larger than the outside diameter of the shank of the rivet.

The portion 11 determines the inside diameter of the tubular or hollow rivet when it has been set, and according to the teachings of the invention the diameter D3 of the portion 15 and the cross dimension A of the portion 16 should be maximally as large as said inside diameter, i.e. the diameter D2 of the portion 11, and preferably they should be smaller than the diameter D2 so that they can pass freely through the passage left in the rivet when the portion 11 has been withdrawn therethrough.

The axial distance between the portion 11 and the portion 16 should be as large as the total length of the rivet to be set and preferably larger than said length for reasons that will be clear from the following description.

Figure 5:
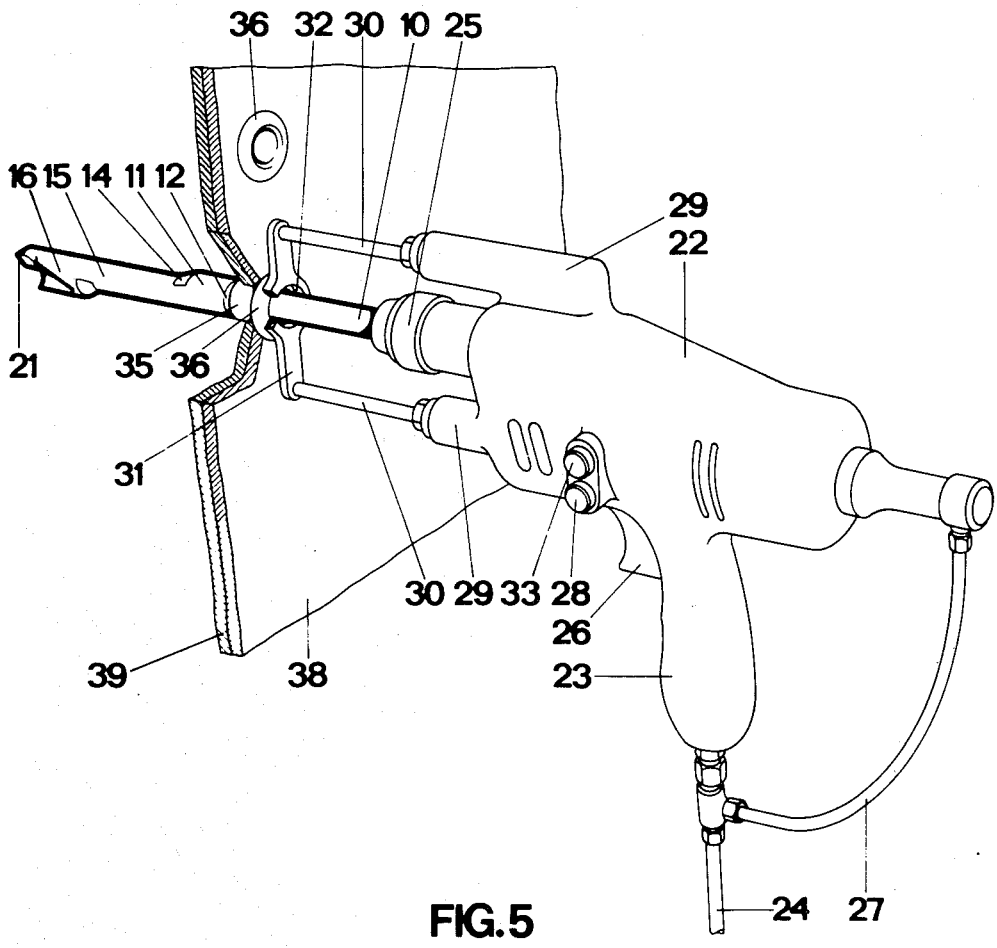
FIG. 5 is a perspective view of a machine tool for working the method according to the teachings of the invention by using the mandrel disclosed in FIG. 1 to 4, for interconnecting two metal sheets by blind riveting.

The mandrel described can be used in a machine tool as that illustrated in FIG. 5. This machine tool can be of the electric or pneumatic type. In the embodiment illustrated it is of the pneumatic type and comprises a housing 22 enclosing a geared turbine motor, and this housing forms a handle 23 for holding the machine tool by hand. Pressurized air is supplied through a hose 24 to the motor enclosed by the housing for rotating a chuck 25 connected to the motor, and the supply of pressurized air is controlled by a finger-operated trigger 26 operatively connected to an air valve. The chuck 25 preferably is of the automatic type which is pneumatically operated to firmly grip the mandrel at the stem 10, and for this purpose there is a branched off supply hose 27 for pressurized air. A push button 28 operatively connected to an air valve can be operated in order to relieve the pressure from the chuck when it is desired to remove the mandrel from the chuck.

On the housing there are arranged on diametrically opposite sides of the chuck two pneumatic cylinders 29 the piston rods 30 of which are connected to a cross head 31 having a central circular opening 32 wide enough to receive the stem 10 and also wide enough to allow the wider portion 11 to pass freely therethrough. Pressurized air can be supplied to the two cylinders 29 simultaneously through hose 27 when a push button 33 operatively connected to an air valve, is operated in order to press forward the cross head 31. Springs may be arranged inside the cylinders for returning the piston rods and thus the cross head when the supply of air is cut off and the cylinders are vented to the atmosphere.

The machine tool of FIG. 5 forms no part of this invention. The method in blind riveting according to the teachings of the invention can be performed with any other suitable machine tool used for drilling and combined with means for obtaining an axial relative motion of the mandrel and an abutment in the manner that is common in blind riveting tools.

Referring to FIGS. 6 to 10 the steps of setting a blind rivet by using the method according to the teachings of the invention will be described in more detail.

Figure 6:
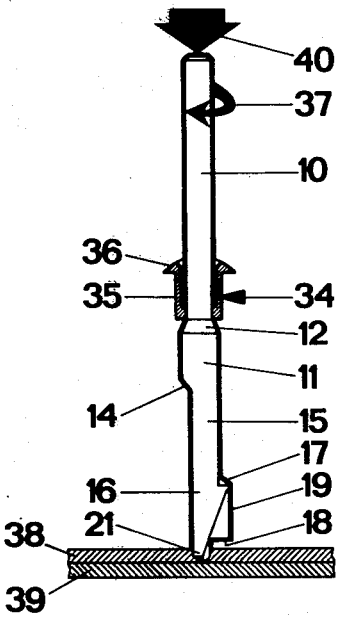
FIG. 6 is a side view, partially a cross sectional view, showing the mandrel with a rivet slipped on to the stem thereof, and the two metal sheets and illustrating a first step of the method according to the teachings of the invention.

In the first step illustrated in FIG. 6 a hollow or tubular rivet 34 of the Chobert type for blind riveting having a shank 35 and a round head 36 is slipped on to the stem 10 of the mandrel described with reference to FIGS. 1 to 4 from the upper end thereof, the mandrel then being attached to the machine tool such as that described with reference to FIG. 5 by clamping the stem in the chuck 25. When the mandrel is being rotated as indicated by the arrow 37 the centre pin 21 is pressed against the outer one of two metal sheets 38, 39 to be interconnected by the blind-riveting process as indicated by the arrow 40. By the centre pin 21 formed as a drill bit there is drilled in this first step of the method according to the teachings of the invention a centre or guide hole through the two metal sheets, having a diameter which is considerably smaller than the outer diameter of the shank 35 of the rivet.

Figure 7:
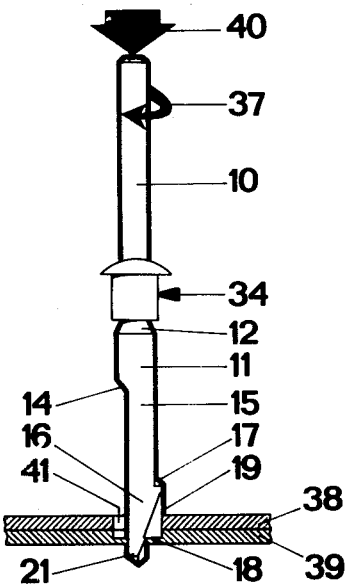
FIGS. 7 to 10 are similar views as that in FIG. 6 disclosing further steps of the method.

In the next step of the method, illustrated in FIG. 7, the drilling is continued and the drill bits 18 and 19 of the projection 16 come into contact with the metal sheets to cut a hole 41 therein which has the diameter 2R mentioned above, i.e. the hole has a diameter slightly larger than the outside diameter of the shank 35 of the rivet 34 to be sufficiently wide for the insertion of the shank of the rivet therethrough. During this step the drill bits 18 and 19 rotate about the axis 13 of the mandrel, the centre pin 21 forming a guide pin for such rotating movement.

Figure 8:
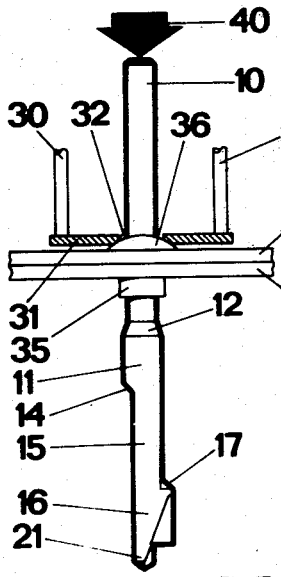

When there has been drilled by the steps described with reference to FIGS. 6 and 7 a hole 41 through the two metal sheets 38 and 39 the mandrel and the rivet thereon are displaced axially in order to insert the shank 35 of the rivet into the hole thus drilled as is illustrated in FIG. 8 the head 36 of the rivet resting against the outer metal sheet 39.

Figure 9:
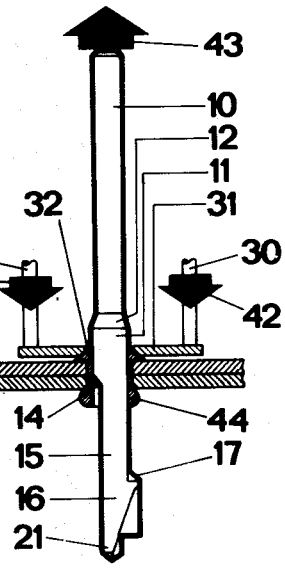
Figure 10:
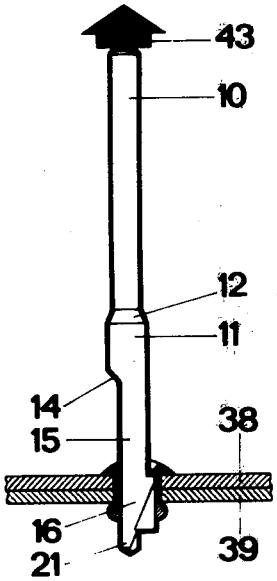

As will be seen in FIG. 5 the step illustrated therein is the step that is illustrated in FIG. 8 the conical shoulder 12 abutting the end of the shank of the rivet preparatory to the following step of the method according to the invention, illustrated in FIG. 9.

Now, pressurized air is supplied to the cylinders 29 in order to displace the cross head 31 against the head 36 of the rivet as in the position shown in FIG. 8, and in the next step, illustrated in FIG. 9, the mandrel is withdrawn from the position shown in FIG. 8 a force being applied to the cross head 31 by the cylinders 29 as indicated by the arrows 42 so that the machine tool and thus the mandrel attached thereto are displaced upwardly as seen in FIG. 9 where such movement has been indicated by an arrow 43. During such movement the wide portion 11 of the mandrel is drawn through the tubular or hollow rivet, and since the inside diameter of the rivet is smaller than the outside diameter of portion 11, the end of the rivet will be burred-over at 44 and the rivet will be widened to fill out the hole 41 and grip the surrounding metal of the two metal sheets. The conical surface 12 facilitates the withdrawal of portion 11 through the rivet. This step illustrated in FIG. 9 completes the setting of the rivet which now fixedly holds the two metal sheets together in the same manner as any blind rivet does adapted to be set by withdrawal of a mandrel through it.

However, the mandrel according to the invention operating as a drill for cutting a hole which is at least as large as the outer diameter of the shank of the rivet has to be removed from the rivet. When the portion 15 of the mandrel, which has a diameter that is smaller than the diameter of the wide portion 11 and thus easily passes through the passage of the set rivet, is displaced transversely to the left as seen in the drawings the eccentric portion 16 of the mandrel can be centered in the passage of the rivet, FIG. 10. As mentioned above the distance between the portion 11 and the portion 16 should be longer than the total length of the rivet so that the portions 11 and 16 can be located at opposite sides or ends of the rivet in order to allow the transverse displacement of the mandrel. Because the eccentric portion 16 has a largest cross dimension which is no larger than the diameter of the portion 11 and preferably is smaller than said diameter, the portion 16 can pass through the passage of the rivet and thus the mandrel can be completely removed from the set rivet in order to be used for another blind riveting operation.

Before a further blind-riveting operation can be performed the mandrel must be detached from the machine tool of FIG. 5 in order to allow a rivet to be slipped on to the stem 10 from the end thereof which is opposite to the centre pin 21. Then, the mandrel is attached again to the chuck 25 of the machine tool and the implement is ready again for the following blind-riveting operation.

It will be apparent to those skilled in the art that various modifications and variations in addition to those mentioned above could be made in the blind-riveting method of the invention and the mandrel of the invention for working such method without departing from the scope and spirit of the invention.

We claim:

1. In a method for blind riveting wherein a hollow or tubular rivet is slipped onto one end of a mandrel and the shank of the rivet, after having been inserted through a hole together with the mandrel extending through the rivet, is widened by withdrawing the mandrel through the rivet to set the rivet and wherein the hole is cut by using the mandrel as a drill, the improvement comprising cutting the hole by means of a drill bit located on the mandrel at the other end thereof that is eccentric in relation to the axis of the mandrel, widening the rivet by means of a cylindrical portion on the mandrel located between the said one end thereof and said bit to an inside diameter at least as large as the largest cross dimension of the eccentric bit and removing the mandrel from the set rivet by passing the eccentric bit through the rivet.

2. The method of claim 1 wherein after the rivet has been widened and set and before the eccentric bit is passed through the rivet, the mandrel is displaced transversely of the shank of the rivet to the side opposite to that where the eccentric bit is located.

3. The method of claim 1 or 2 including initially drilling a guide bore having a smaller diameter than the intended diameter of the hole, by using a centrally located drill bit on the mandrel, the guide bore then being widened to the intended diameter for the rivet by the eccentric bit.

4. A mandrel for blind riveting comprising a stem at one end thereof onto which a hollow or tubular rivet can be slipped, a bit located at the other end of the mandrel eccentrically in relation to the axis of the mandrel, a cylindrical portion located between the stem and the eccentric bit of the mandrel for widening the rivet, the largest cross dimension of the eccentric bit being no larger than the diameter of the cylindrical portion and the cylindrical portion being spaced axially from the eccentric bit.

5. The mandrel of claim 4 wherein the mandrel at said other end has a center pin coaxial with the axis of the mandrel forming a drill bit the diameter of which is smaller than the diameter of the circle described by the eccentric bit when the mandrel is rotated.

6. The mandrel of claim 4 or 5 wherein the portion of the mandrel between the eccentric bit and the cylindrical portion is eccentric towards the same side as the eccentric bit and has a diameter which is smaller than the largest cross dimension of the eccentric bit and the diameter of the cylindrical portion.

7. The mandrel of claim 4 or 5 wherein the cylindrical portion is spaced axially from the eccentric bit a distance which is at least as large as the total length of the rivet to be set.

* * * * *